US007431614B2

(12) United States Patent
Eriksen

(10) Patent No.: US 7,431,614 B2
(45) Date of Patent: Oct. 7, 2008

(54) SLEEVE FOR SECURING A CABLE IN A CONNECTOR

(75) Inventor: Kim Eriksen, Vordingborg (DK)

(73) Assignee: John Mezzalingua Assoc., Inc., East Syracuse, NY (US)

( * ) Notice: Subject to any disclaimer, the term of this patent is extended or adjusted under 35 U.S.C. 154(b) by 0 days.

(21) Appl. No.: 11/801,814

(22) Filed: May 11, 2007

(65) Prior Publication Data

US 2007/0270032 A1 Nov. 22, 2007

(30) Foreign Application Priority Data

May 18, 2006 (DK) ..... 2006 00693

(51) Int. Cl.
*H01R 9/05* (2006.01)

(52) U.S. Cl. ..... 439/578

(58) Field of Classification Search ..... 439/578, 439/584, 579–583, 585; 280/1; 285/26; 174/25 C See application file for complete search history.

(56) References Cited

U.S. PATENT DOCUMENTS 3,963,320 A 6/1976 Spinner 5,267,877 A * 12/1993 Scannelli et al. ..... 439/584

6,939,169 B2 * 9/2005 Islam et al. ..... 439/578

FOREIGN PATENT DOCUMENTS

EP 0599602 6/1994

* cited by examiner

*Primary Examiner*—Alexander Gilman
(74) *Attorney, Agent, or Firm*—Melissa Bitting

(57) ABSTRACT

To ensure stable physical and electrical contact between an exposed outer conductor of a cable and a compression sleeve, which has two sections, where the first section is disposed around the jacket of the cable, while the second section is disposed around the outer conductor of the cable, which is corrugated, and where the shield and the jacket of the cable are mounted in a connector formed by a front nut and a connector body, screwing together of the front nut and connector body will cause the compression sleeve to be clamped tightly to the outer conductor, as a compression ring is disposed around the second section, said compression ring has coned or ramped surfaces on the sleeve, said coned or ramped surfaces being disposed at the free end of the first section and at the transition between the first section and the second section.

14 Claims, 3 Drawing Sheets

SLEEVE FOR SECURING A CABLE IN A CONNECTOR

FIELD OF THE INVENTION

The invention relates to a compression sleeve for securing a cable in a connector, the cable having a jacket below which an outer conductor is provided, the connector being formed by a connector body and a front nut, the compression sleeve having two sections, a first section or first end of which encloses a portion of the outer conductor whose surface is corrugated, and a second section or second end of which encloses the jacket enclosing the cable.

BACKGROUND OF THE INVENTION

When transmitting HF signals through cables that are connected by connectors in which the center conductor and the outer conductor of the cable are stripped of insulation, it is very important that quite stable, electrical conditions prevail inside the connector. These electrical conditions must not change even when the cable is subjected to mechanical impacts, e.g. in the vicinity of the connector.

In particular, it is important that the outer conductor of the cable cannot move relative to the holding means that are present inside the connector. Such holding means may be a compression sleeve having two sections. The first section or first end of the compression sleeve encloses the outer conductor of the cable, while the second section or second end encloses the jacket of the cable. As a threaded front nut is screwed together with the connector body, the compression sleeve exerts a pressure against the cable.

In a prior art compression sleeve, the pressure is exerted against the cable jacket by projections arranged on the inner side of the second section or second end of the compression sleeve, which may have the unfortunate effect that the first section or first end of the compression sleeve does not obtain a sufficient grip around the outer conductor. This may mean that if the portion of the cable disposed near the connector is subjected to physical impacts, the compression sleeve may be disengaged partly from the outer conductor. This means that the electrical conditions change, causing wrong signal transmission through the cable.

Accordingly, an objection of the invention is to provide a compression sleeve where the above-mentioned drawbacks are remedied.

SUMMARY OF THE INVENTION

The object of the invention is achieved by a compression sleeve which is characterized in that the first section or first end of the compression sleeve is enclosed by a compression ring which, when the front nut is threaded together with the connector body, presses the first section or first end of the compression sleeve against the outer conductor of the cable.

This ensures a very firm and stable grip around the outer conductor which cannot be changed by physical impacts exerted against the portion of the cable which is disposed near the connector.

The first section or first end of the compression sleeve is configured as a coned or ramped surface and the transition between the first section or first end and the second section or second end is configured as a coned or ramped surface. When the compression ring is formed with a coned or ramped surface that adjoins the coned or ramped surface of the first section or first end, a great clamping force is achieved from the compression sleeve against both the cable jacket and the outer conductor.

To enhance the contact between the compression sleeve and the outer conductor of the cable, it is advantageous that the first section or first end of the compression sleeve have an inner, rounded portion that corresponds to the corrugated portion of the outer conductor. In other words, the entire inner surface of the first section or first end of the compression sleeve has the same geometry as the outer surface of the exposed outer conductor.

To ensure that the compression sleeve cannot slide axially relative to the outer conductor, it is advantageous that the coned or ramped surface at the first section or first end of the compression sleeve terminate by a projection defining a hole which has the same diameter as the hole in the free end of the exposed outer conductor.

Finally, it is expedient that the inner surface of the second section or second end of the compression sleeve is formed with a projection, which ensures damping of vibrations from the cable, when it is manipulated in the vicinity of the connector.

DESCRIPTION OF THE PREFERRED EMBODIMENT(S)

Figure 1:
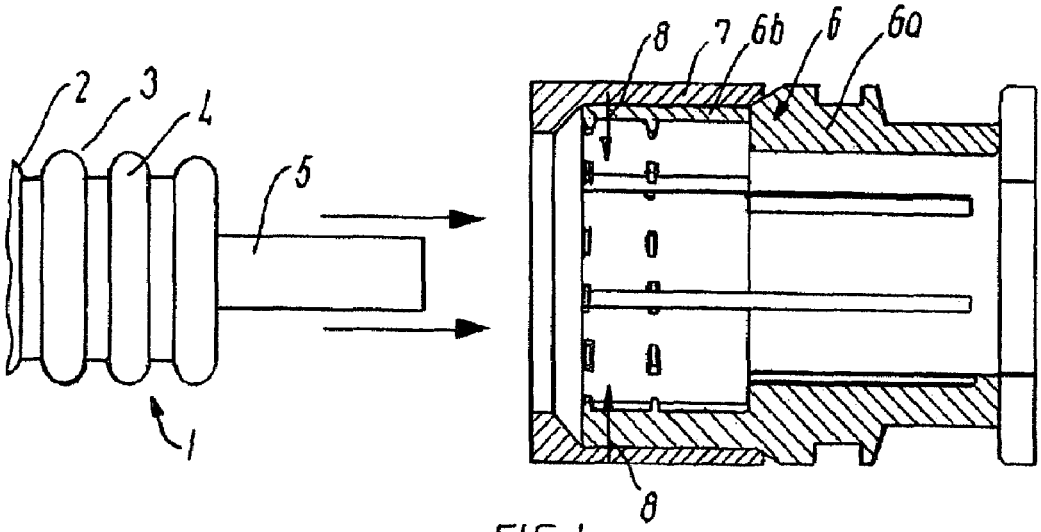
FIG. 1 depicts a cable before it is secured to a connector, which has a known compression sleeve for securing the cable.

Referring to FIGS. 1-4, the numeral 1 designates a cable for the transmission of HF signals, e.g. for mobile telephony.

The cable 1 has a jacket 2 which encloses an outer conductor 3 with corrugated portions 4, which in turn encloses the center conductor 5 of the cable, a dielectric (not shown) being provided between the center conductor 5 and the outer conductor 3.

Figure 2:
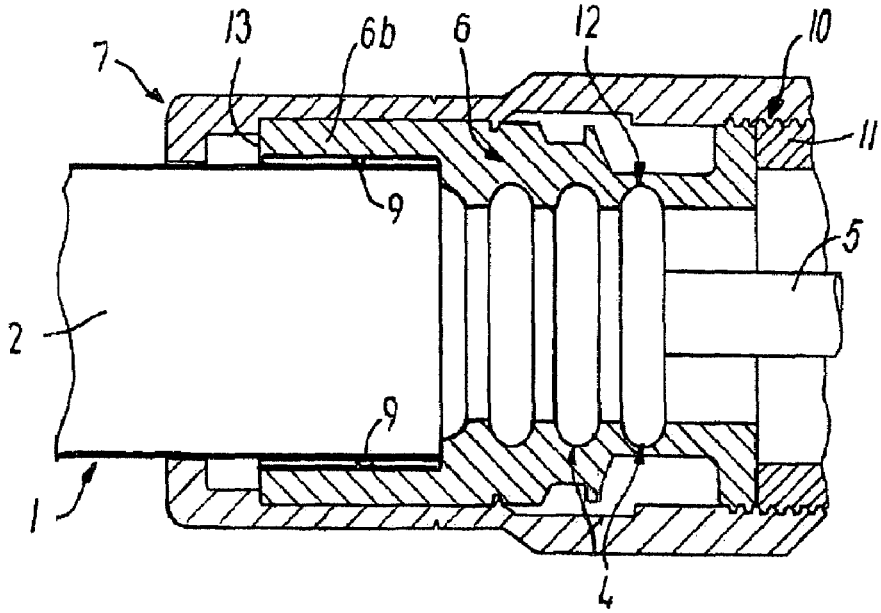
FIG. 2 depicts the cable of FIG. 1 mounted in the connector.

FIGS. 1 and 2 show a prior art compression sleeve 6 made of metal, which has a first section or first end 6*a* and a second section or second end 6*b*. The compression sleeve is intended to secure the cable in a connector, which is composed of a connector body 7 and a front nut 11 which may be assembled by threads 10.

When the front nut 11 and connector body 7 are screwed together, surface 13 of second section or second end 6 will engage a first surface on connector body 7. Projections 8 and 9 on the inner side of the second section or second end 6*b* of the compression sleeve 6 will exert a pressure against jacket 2 of cable 1, while a pressure will be exerted against the first section or first end 6*a* in an axial direction toward the outer conductor 3.

If the jacket 2 of cable 1 in the vicinity of the connector is subjected to mechanical impacts, this may cause the compression sleeve 6 in the first section or first end 6*a* to lose contact, which in turn means that the electrical characteristic of the cable 1 near the outer conductor 3 will be unstable at an engagement face 12 between the outer conductor 3 and the first section or first end 6*a* of the compression sleeve 6.

Figure 3:
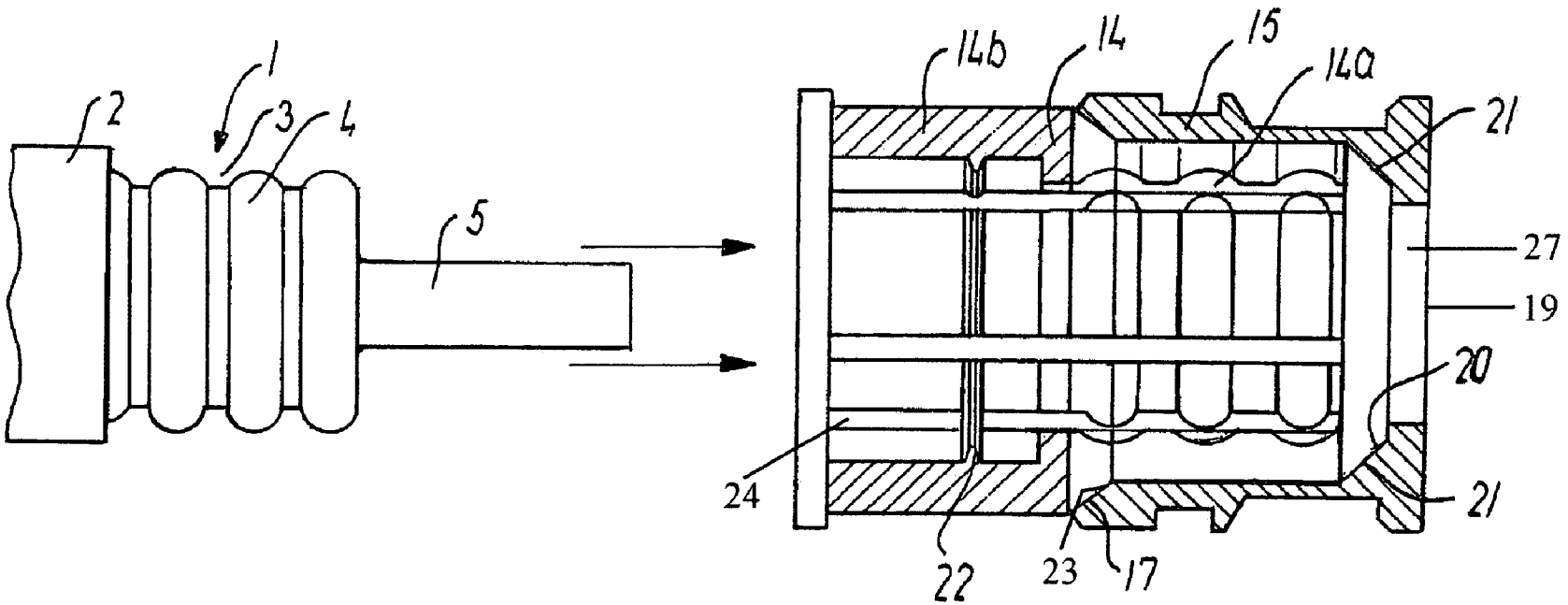
FIG. 3 depicts a cable before it is secured to a connector, the connector having a compression sleeve according to the present invention.
Figure 4:
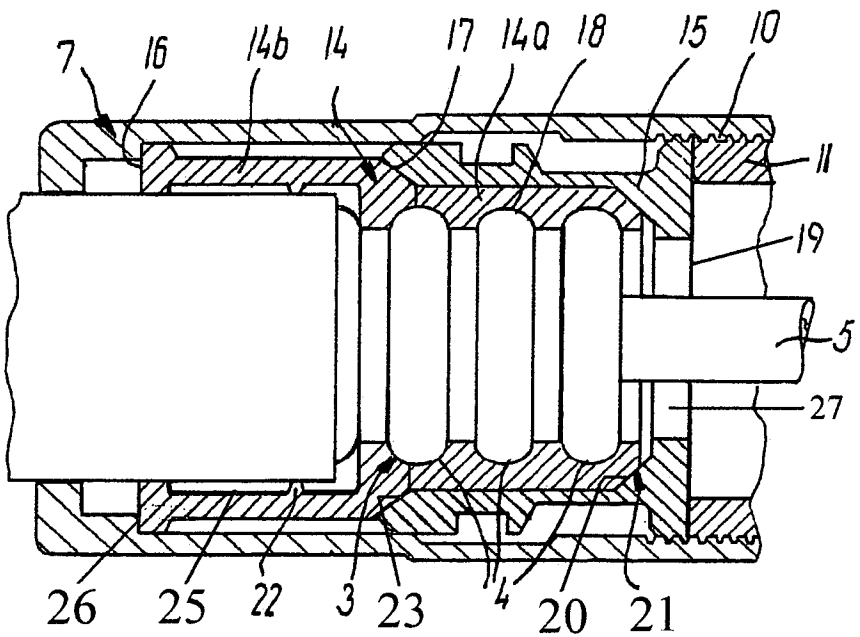
FIG. 4 depicts the cable of FIG. 3 mounted in the connector.

Referring now to FIGS. 3 and 4, it will be explained how the present invention avoids this electrical instability.

FIGS. 3 and 4 show a compression sleeve 14 of the present invention that has a first section or first end 14*a* and a second section or second end 14*b*. The inner face of the first section or first end 14*a* has corrugated portion or second surface 18 with the same geometry as the corrugated portions 4 of outer conductor 3. The inner surface of the second section or second end 14*a* has arranged thereon an annular projection 22 that is capable of pressing against the jacket 2 of cable 1. Compression sleeve 14 has at least one slot 24 to increase compressive action.

A compression ring 15 of metal is mounted externally on the first section or first end 14*a*, compression ring 15 having a compression ring passageway 27 which fits for engagement with the outer surface of the first section or first end 14*a*. At the end facing the second section or second end 14*b* of compression sleeve 14, the compression ring 15 has a coned or second compression ring ramped surface 17 which adjoins a coned or second compression sleeve ramped surface 23 on the second section or second end 14*b*.

At the opposite end of the second section, compression ring 15 has an additional coned or first compression ring ramped surface 21 which adjoins a coned or first compression sleeve ramped surface 20 of the first section or first end 14*a* of compression sleeve 14.

Referring to FIG. 4, compression ring passageway 27 has a transitional opening 19 which is disposed in extension of the coned or first compression ring ramped surface 21 and extends inwards toward the axis of cable 1, so that the transitional opening 19 forms a hole with a diameter that corresponds to the diameter of the outer conductor 3.

It will now be explained how the cable 1 is inserted into the connector. The compression sleeve 14 with the compression ring 15 is pushed inwards over cable 1, so that the compression sleeve second section or second end 14*b* with an annular projection 22 encloses the cable jacket 2. Meanwhile, first section or first end 14*a* of compression sleeve 14 encloses outer conductor 3.

When the front nut 11 is screwed together with connector body 7, surface 16 of second section or second end 14*b* of compression sleeve engages a first surface 26 on connector body 7. Compression sleeve 14 applies pressure against the cable jacket 2 at annular projection 22 and at area 18, while the transitional opening 19 presses the first section or first end 14*a* of the compression sleeve 14 tightly against the outer conductor 3. Outer conductor 3 will thus be secured firmly and immovably in the connector.

While I have illustrated and described preferred embodiments of my invention, it is understood that this is capable of modifications, and I therefore do not wish to be limited to precise details set forth, but desire to avail myself of such changes and alterations as fall within the purview of the following claims.

I claim:

1. A sleeve for securing a cable in a connector, said cable having an outer jacket below which an outer conductor is provided, said connector being formed by a front nut and a connector body, said sleeve having two sections, a first section which encloses a portion of the outer conductor of the cable whose surface is corrugated, and a second section of which encloses a portion of the jacket enclosing the cable in extension of the first section, a compression ring enclosing the first section and engaging the second section wherein as the front nut is screwed together with the connector body, the compression ring presses the first section of the sleeve against the outer conductor and compresses the second section against the outer conductor.

2. A sleeve according to claim 1, characterized in that a first end of the compression ring is configured as a cone to engage the first section of the sleeve, and that the engagement between the compression sleeve and the second section is configured as a cone.

3. A sleeve according to claim 2, characterized in that the compression ring is configured with cone faces which adjoin the cone faces of the second section.

4. A sleeve according to claim 1, characterized in that the first section, at its outer area, has an inner rounded portion which corresponds to an outer rounded portion of the exposed outer conductor.

5. A sleeve according to claim 1, characterized in that the entire inner surface of the first section has the same geometry as the outer surface of the exposed outer conductor.

6. A sleeve according to claim 4, characterized in that its cone-shaped part, at the first end, is terminated by a projection defining a hole which has the same diameter as the hole in the free end of the outer conductor.

7. A sleeve according to claim 1, characterized in that the inner surface of the second section is formed with a projection.

8. A connector for coupling an end of a coaxial cable, the coaxial cable having a center conductor surrounded by a dielectric material, the dielectric surrounded by a corrugated outer conductor, the corrugated outer conductor surrounded by a jacket, the connector comprising:

a connector body having a first end and a second end, the connector body having an internal passageway defined therein, the connector body further having a first surface proximate the second end for engaging a compression sleeve;

a compression sleeve disposed within the internal passageway of the connector body, the compression sleeve having a first compression sleeve section having a first section passageway configured to receive the corrugated outer conductor and a second compression sleeve section having a second section passageway defined therein;

a compression ring disposed within the internal passageway, the compression ring having a compression ring passageway, the compression ring enclosing the first compression sleeve section and engaging the second compression sleeve section, a the compression ring passageway having a transitional opening at one end; and, a nut threadably secured to the first end of the connector body, whereby axial advancement of the nut towards the second end of the connector body axially advances the compression ring towards the compression sleeve which causes the second compression sleeve section to engage the first surface, and upon further axial advancement of the compression ring, the compression ring presses the first compression sleeve section against the outer conductor and compresses the second compression sleeve section against the outer conductor.

9. The connector of claim 8, wherein the first end of the compression ring has a first compression ring ramped surface configured to engage the first compression sleeve section and that the engagement between the compression sleeve and the second compression sleeve section is configured as a ramped surface.

10. The connector of claim 8, the compression sleeve having at least one slot extending along a longitudinal axis.

11. A method of attaching a coaxial cable connector to a coaxial cable, the coaxial cable having a center conductor surrounded by a corrugated outer conductor, the corrugated outer conductor surrounded by a jacket, the connector comprising: a connector body having an internal passageway, a compression sleeve having a first section configured to receive the corrugated outer conductor and a second section configured to enclose a portion of the jacket disposed within the internal passageway and a compression ring disposed within the internal passageway, the compression ring enclosing the first section and engaging the second section, the method comprising the steps of:

inserting prepared end of the coaxial cable into the connector;

threading the corrugated outer conductor into the compression sleeve first section;

axially advancing the compression ring along a longitudinal axis, whereby axial advancement of the compression ring causes the compression ring to press the first section of the sleeve against the outer conductor and compresses the second section of the sleeve against the outer conductor.

12. The method of claim 11, wherein the step of axially advancing the compression ring further includes compressing the compression sleeve with a first surface disposed within the internal passageway.

13. The method of claim 11, wherein the step of axially advancing the compression ring further includes compressing the jacket with an arcuate projection disposed within the compression sleeve.

14. The method of claim 11, wherein the step of axially advancing the compression ring further includes compressing the outer conductor with a transitional opening formed within the compression sleeve.

* * * * *